US009293849B2

(12) United States Patent
Balsells et al.

(10) Patent No.: US 9,293,849 B2
(45) Date of Patent: Mar. 22, 2016

(54) ELECTRICAL CONNECTOR USING A CANTED COIL MULTI-METALLIC WIRE

(75) Inventors: Pete Balsells, Foothill Ranch, CA (US); Rob Sjostedt, Foothill Ranch, CA (US); Farshid Dilmaghanian, Foothill Ranch, CA (US)

(73) Assignee: Bal Seal Engineering, Inc., Foothill Ranch, CA (US)

( * ) Notice: Subject to any disclaimer, the term of this patent is extended or adjusted under 35 U.S.C. 154(b) by 233 days.

(21) Appl. No.: 12/511,518

(22) Filed: Jul. 29, 2009

(65) Prior Publication Data

US 2010/0029145 A1 Feb. 4, 2010

Related U.S. Application Data

(60) Provisional application No. 61/084,762, filed on Jul. 30, 2008.

(51) Int. Cl.

| | |
|---|---|
| ***H01R 13/17*** | (2006.01) |
| ***H01R 13/03*** | (2006.01) |
| ***H01R 13/24*** | (2006.01) |
| ***H01R 24/58*** | (2011.01) |
| ***H01R 39/20*** | (2006.01) |
| *H01R 13/187* | (2006.01) |

(52) U.S. Cl.

CPC ..... *H01R 13/03* (2013.01); *H01R 13/17* (2013.01); *H01R 13/2421* (2013.01); *H01R 24/58* (2013.01); *H01R 39/20* (2013.01); *H01R 13/187* (2013.01); *H01R 2201/12* (2013.01)

(58) Field of Classification Search

CPC ..... H01R 13/15; H01R 13/17; H01R 13/187; H01R 13/2407; H01R 13/6277

USPC ..... 439/827, 349, 840, 841, 909, 675; 29/896.9

See application file for complete search history.

(56) References Cited

U.S. PATENT DOCUMENTS

| | | | | |
|---|---|---|---|---|
| 3,251,660 | A * | 5/1966 | Finsterwalder | 428/675 |
| 3,258,736 | A * | 6/1966 | Crawford et al. | 439/786 |
| 4,072,154 | A | 2/1978 | Anderson et al. | |

(Continued)

FOREIGN PATENT DOCUMENTS

EP 0437227 A2 7/1991

OTHER PUBLICATIONS

International Search Report completed Jan. 26, 2010 and mailed Jan. 27, 2010 from corresponding International Application No. PCT/US2009/052079, filed Jul. 29, 2009 (3 pages).

(Continued)

*Primary Examiner* — Vanessa Girardi

(74) *Attorney, Agent, or Firm* — Klein, O'Neill & Singh, LLP

(57) ABSTRACT

A canted coil spring made from multi-metallic wire to achieve combinations of desired material characteristics of different metals is discussed. Wire to be used in canted coil springs can have two or more metals oriented co-axially along such wire, such as an outer layer of one metal having one set of properties, and a core of a different metal having a different set of properties, that will achieve a single solid, multi-metallic wire with enhanced performance over a single material canted coil spring. Such features may be found advantageous in electrical applications, such as where both high electrical conductivity and high strength properties are desired.

25 Claims, 8 Drawing Sheets

(56) References Cited

U.S. PATENT DOCUMENTS

| | | | | |
|---|---|---|---|---|
| 4,105,037 | A | 8/1978 | Richter et al. | |
| 4,202,592 | A | 5/1980 | Rullier et al. | |
| 4,262,673 | A | 4/1981 | Kinney et al. | |
| 4,461,194 | A | 7/1984 | Moore | |
| 4,655,462 | A | 4/1987 | Balsells | |
| 4,678,210 | A | 7/1987 | Balsells | |
| 4,826,144 | A | 5/1989 | Balsells | |
| 4,876,781 | A | 10/1989 | Balsells | |
| 4,907,788 | A | 3/1990 | Balsells | |
| 4,915,366 | A | 4/1990 | Balsells | |
| 4,929,188 | A | 5/1990 | Lionetto et al. | |
| 4,934,366 | A | 6/1990 | Truex et al. | |
| 4,964,204 | A | 10/1990 | Balsells | |
| 5,082,390 | A | 1/1992 | Balsells | |
| 5,108,078 | A | 4/1992 | Balsells | |
| 5,134,244 | A | 7/1992 | Balsells | |
| 5,139,243 | A | 8/1992 | Balsells | |
| 5,139,276 | A | 8/1992 | Balsells | |
| 5,288,242 | A | 2/1994 | Muzslay | |
| 5,411,348 | A | 5/1995 | Balsells | |
| 5,413,595 | A | 5/1995 | Stutz, Jr. | |
| 5,474,309 | A | 12/1995 | Balsells | |
| 5,545,842 | A | 8/1996 | Balsells | |
| 5,615,870 | A | 4/1997 | Balsells | |
| 5,704,809 | A | 1/1998 | Davis | |
| 5,709,371 | A | 1/1998 | Balsells | |
| 5,711,901 | A | 1/1998 | Berg et al. | |
| 5,752,847 | A | 5/1998 | McCormick | |
| 5,766,042 | A | 6/1998 | Ries et al. | |
| 5,791,638 | A | 8/1998 | Balsells | |
| 5,817,984 | A | 10/1998 | Taylor et al. | |
| 5,866,851 | A | 2/1999 | Taylor et al. | |
| 6,029,089 | A | 2/2000 | Hawkins et al. | |
| 6,192,277 | B1 | 2/2001 | Lim et al. | |
| 6,428,368 | B1 | 8/2002 | Hawkins et al. | |
| 6,498,952 | B2 | 12/2002 | Imani et al. | |
| 6,607,393 | B2 | 8/2003 | Raypole et al. | |
| 6,671,554 | B2 | 12/2003 | Gibson et al. | |
| 6,749,358 | B2 | 6/2004 | Balsells | |
| 6,835,084 | B2 * | 12/2004 | Poon et al. | 439/349 |
| 6,869,301 | B2 | 3/2005 | Shimizu et al. | |
| 6,878,013 | B1 | 4/2005 | Behan | |
| 6,879,857 | B2 | 4/2005 | Swanson et al. | |
| 6,895,276 | B2 * | 5/2005 | Kast et al. | 607/37 |
| 7,003,351 | B2 | 2/2006 | Tvaska et al. | |
| 7,047,077 | B2 | 5/2006 | Hansen et al. | |
| 7,055,812 | B2 | 6/2006 | Balsells | |
| 7,062,329 | B2 | 6/2006 | Ostroff | |
| 7,063,563 | B1 | 6/2006 | Hsu | |
| 7,070,455 | B2 | 7/2006 | Balsells | |
| 7,083,474 | B1 | 8/2006 | Fleck et al. | |
| 7,108,549 | B2 | 9/2006 | Lyu et al. | |
| 7,110,827 | B2 | 9/2006 | Sage et al. | |
| 7,120,027 | B2 | 10/2006 | Yatskov et al. | |
| 7,164,951 | B2 | 1/2007 | Ries et al. | |
| 7,175,441 | B2 | 2/2007 | Naviaux et al. | |
| 7,187,974 | B2 | 3/2007 | Haeg et al. | |
| 7,195,523 | B2 | 3/2007 | Naviaux | |
| 7,241,180 | B1 | 7/2007 | Rentas Torres | |
| 7,263,401 | B2 | 8/2007 | Scott et al. | |
| 7,274,964 | B2 | 9/2007 | Balsells | |
| 7,299,095 | B1 | 11/2007 | Barlow et al. | |
| 7,303,422 | B2 | 12/2007 | Hoffer et al. | |
| 7,316,593 | B2 | 1/2008 | Balsells | |
| 7,326,083 | B2 | 2/2008 | Mehdizadeh et al. | |
| 7,429,199 | B2 | 9/2008 | Burgess | |
| 2001/0020545 | A1 * | 9/2001 | Eldridge et al. | 174/260 |
| 2003/0157846 | A1 | 8/2003 | Poon et al. | |
| 2004/0245686 | A1 | 12/2004 | Balsells | |
| 2005/0234521 | A1 | 10/2005 | Balsells | |
| 2005/0242910 | A1 | 11/2005 | Balsells | |
| 2006/0095086 | A1 | 5/2006 | Balsells | |
| 2006/0146500 | A1 | 7/2006 | Yatskov | |
| 2006/0161215 | A1 | 7/2006 | Naviaux | |
| 2006/0211276 | A1 | 9/2006 | Li | |
| 2006/0224208 | A1 | 10/2006 | Naviaux | |
| 2006/0228166 | A1 | 10/2006 | Balsells | |
| 2007/0042648 | A1 | 2/2007 | Balsells | |
| 2008/0053811 | A1 | 3/2008 | Balsells et al. | |
| 2008/0245231 | A1 | 10/2008 | Gniesmer et al. | |
| 2008/0254670 | A1 | 10/2008 | Balsells et al. | |
| 2008/0255631 | A1 | 10/2008 | Sjostedt et al. | |

OTHER PUBLICATIONS

Written Opinion completed Jan. 26, 2010 and mailed Jan. 27, 2010 from corresponding International Application No. PCT/US2009/052079, filed Jul. 29, 2009 (4 pages).

Office Action dated Feb. 24, 2010 from related U.S. Appl. No. 12/102,626, filed Apr. 14, 2008.

* cited by examiner

SECTION A-A

SECTION A-A

SECTION B-B

SECTION A-A

ELECTRICAL CONNECTOR USING A CANTED COIL MULTI-METALLIC WIRE

CROSS-REFERENCE TO RELATED APPLICATION

This is a regular utility application of provisional application Ser. No. 61/084,762, filed Jul. 30, 2008; the contents of which are expressly incorporated herein by reference.

BACKGROUND

Canted coil springs have a wide range of applications in many fields, for example, in medical devices, analytical instruments, industrial equipment, wind solar power devices, green technology, and in various aerospace and automotive applications. Furthermore, aside from the mechanical locking and connecting capabilities that canted coil spring applications provide, other properties of canted coil springs are utilized, among which are electrical conductivity. One general limitation of electrically conductive canted coil spring mechanisms is their range of effective operating temperatures.

Most electrically conductive materials consist of copper alloys or aluminum-type alloys because of the high degree of conductivity. However, most materials with high electrical conductivity have a relatively low melting point, resulting in limited temperature resistance. As a result, a problem that typically arises is the tendency for electrically conductive canted coil springs, that is, springs made of copper alloys or aluminum-type alloys, to lose a significant portion of their mechanical properties at high temperatures, causing the locking mechanism or the electrical contact to become less effective or fail altogether. The decrease in strength limits the force that can be applied to electrically conductive canted coil springs, thereby also limiting the use of these canted coil springs in certain applications, especially those applications that require withstanding high mechanical forces in environments with elevated temperatures. Furthermore for electrical contact applications, the low heat resistance of a copper or aluminum alloy contact spring can result in stress relaxation thereby reducing the electrical contact interface stress between the spring and related contact elements.

Most copper alloys operate at temperatures up to approximately 210 degrees Celsius, or 410 degrees Fahrenheit, before the mechanical properties of the alloys begin to degrade. Therefore, the use of traditional electrically conductive canted coil springs in environments continually at or above those temperature ranges is limited. For example, in automotive applications, under-the-hood temperatures generally hover around the order of 210 degrees Celsius, which can cause properties of traditional conductive materials to diminish and not perform as designed. Furthermore, since a spring used as an electrical contact will heat up depending on the electrical current passing through it, the spring can undergo stress relaxation even when the operating environment is not as severe.

SUMMARY

The effective operating performance range for a canted coil spring used as an electrical contact element, or as a combined electrical contact and mechanical holding device, or simply as a mechanical holding device, can be improved in terms of elevated temperature performance by making the canted coil spring wire in a multi-metallic configuration having a temperature resistant metallic core with a highly conductive outer layer.

A method for fastening a first body to a second body using a spring force and conducting electrical conductivity between the first body and the second body, said method comprising positioning a spring in fastener groove defined by the first body and the second body, and applying electrical current through the spring, said spring comprising an inner section comprising a first tensile strength property and a first conductive property and an outer section comprising a second tensile strength property and a second conductive property.

In certain aspects of the present invention, the method further including the step of exposing the first body and the second body to a temperature greater than 210 degrees Celsius.

Although the spring may be a garter-type spring, in certain embodiment, the spring has two ends that are spaced from one another, such as for use in a groove having a linear section.

In a specific application, the first body and the second body is disposed in a wind turbine comprising at least one rotatable blade.

In some embodiments, at least one of the first body and the second body is plated with a conductive material. Exemplary conductive materials include copper, aluminum, gold, platinum, and their alloys.

In another specific application, the first body or the second body is directly or indirectly connected to a battery terminal. The battery terminal could be located, for example, in an automobile or in a water or sea bearing vessel.

In a further aspect of the present invention, a cylindrical electrical connector assembly comprising a plurality of stacked alternating conductive and non-conductive cylindrical elements comprising a plurality of canted coil springs is provided. Each spring is made of an inner material having a first electrically conductive property and an outer material made of a second electrically conductive property.

In a particular application of the connector assembly, each spring incorporates at least two sections having two different tensile strength properties.

In a still further aspect of the present invention, a method for transferring electrical current between a first member and a second member at a temperature of 210 degrees Celsius or higher is provided comprising: providing a groove defined by surfaces of the first member and the second member, and disposing a multi-metallic canted coil spring in the groove, said multi-metallic canted coil spring functions as a conduit for electrical conduction between the first member and the second member.

In a still yet further aspect of the present invention, a medical connector comprising a groove for retaining a spring is provided, said spring having an outside diameter of less than 0.0035 inch, a spring ring inside diameter of less than 0.050 inch, and wherein the spring has an inner core made from a first material having a first tensile strength and a first conductivity and an outer layer made from a second material having a second tensile strength and a second conductivity. In particular aspects of the present invention, the first tensile strength is larger than the second tensile strength and wherein the second conductivity is larger than the first conductivity.

BRIEF DESCRIPTION OF THE DRAWINGS

These and other features and advantages of the present invention will become appreciated as the same become better understood with reference to the specification, claims and appended drawings wherein:

DETAILED DESCRIPTION

The present invention relates generally to multi-metallic coil springs and more particularly to multi-metallic canted coil springs for use in and as part of fastening assemblies and more particularly as part of electrically conductive fastening assemblies. The multi-metallic spring wire configuration improves performance of said assemblies at high temperatures thus allowing their use in elevated temperatures applications, or to allow performance of said assemblies at extremely small scales but not necessarily high temperature applications, thus allowing their use at extremely small sizes, where mechanical performance of fastening assemblies using non-multi-metallic canted coil springs would typically degrade or fail. The detailed description set forth below in connection with the appended drawings is intended as a description of the presently preferred embodiments of multi-metallic canted coil springs and fastening assemblies provided in accordance with aspects of the present invention and is not intended to represent the only forms in which the present invention may be constructed or utilized. The description sets forth the features and the steps for constructing and using the canted coil springs and fastening assemblies of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like or similar elements or features.

Figure 1:
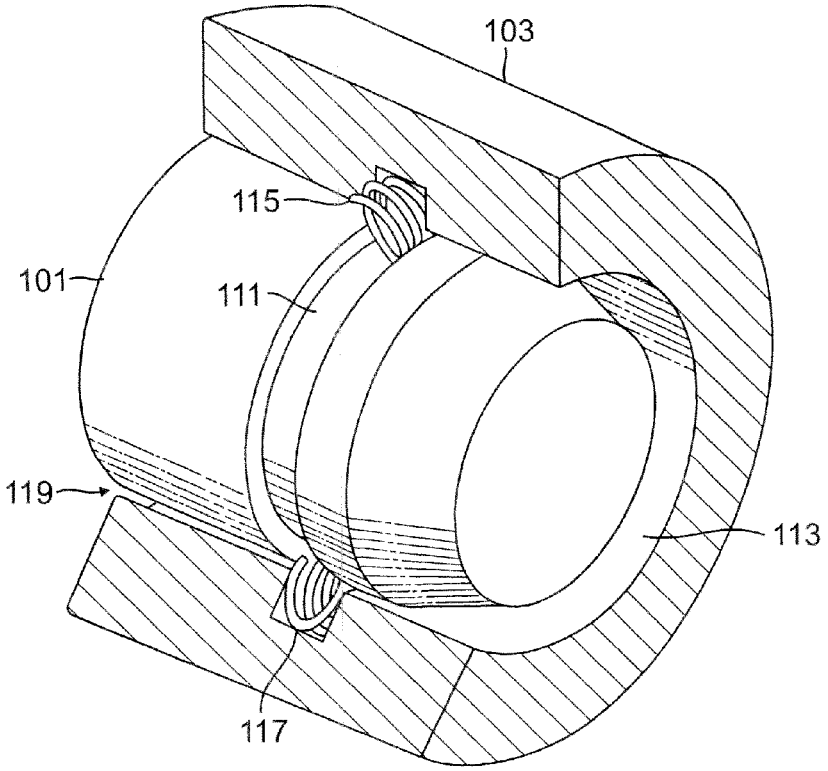
FIG. 1 is a perspective view of a canted coil spring assembly, partially cut away, showing a first and second member fastened to one another by means of a canted coil spring loaded along the major axis thereof.

FIG. 1 shows a fastening assembly including a first member 101 with a first groove 111 located therein, a second member 103 including a bore 113, and a garter-type canted coil spring 115 retained in the first groove. The depth of the first groove 111 is less than a width of the canted coil spring 115, so that a portion of the canted coil spring extends outwardly from the first member 101 when the canted coil spring is retained in the first groove. A second groove 117 is disposed in the bore 113 of the second member 103, positioned for accepting the extending portion of the canted coil spring 115 when the first member is inserted into the bore along an axial direction defined by a lengthwise axis of the first member 101. Upon receipt of the canted coil spring 115 by the second groove 117, the first member 101 and second member 103 are fastened together along the axial direction, thereby deterring or possibly preventing relative separation between the two in that direction depending on the wall surfaces of the two grooves. Although the two grooves 111, 117 are shown with a flat bottom and square side walls, they can be inclined or angled as shown and described in U.S. Pat. Nos. 5,082,390, 6,835,084, and in pending Ser. No. 11/111,109, filed Apr. 21, 2005, the contents of which are expressly incorporated herein by reference.

While the first member 101 and second member 103 are assembled together, there may exist a circumferential gap 119 between the first member and the second member. The first member 101, while fastened in an axial direction with the second member 103, may still be allowed to move slightly within the bore 113 of the second member in radial directions perpendicular to the axis of insertion. Consequently, the first member 101 may be positioned within the bore 113 of the second member 103 so that the first and second members are not in direct contact. As such, only the canted coil spring 115 is in continuous contact with both the first member 101 and second member 103 at all times. In embodiments of the fastening assembly where electrical connectivity between the first member 101 and second member 103 are desired, an electrically conductive canted coil spring should be used to facilitate the connection, thereby ensuring constant electrical conduction between the first member and second member.

However, metals with high electrical conductivity generally have weaker mechanical properties than other metals. Most electrically conductive materials are comprised of copper alloys and/or aluminum-type alloys. These materials have low melting points and low strength properties, generally exhibiting mechanical property degradation at temperatures on the order of 210 degrees Celsius, or 410 degrees Fahrenheit, for example at temperatures greater than 215 degrees Celsius, including greater than 230 degrees Celsius and greater than 250 degrees Celsius. In applications where the electrically conductive alloys are utilized solely for their electrical conductivity, the mechanical tradeoffs are less critical. But if electrically conductive alloys are used to make canted coil springs, as may be the case in FIG. 1, the mechanical limitations of the alloys may compromise the fastening capabilities of the canted coil spring assemblies at elevated temperatures, thereby limiting the potential applicability of the assemblies. While conventional wisdom may teach a skilled artisan to add complex mechanical engagements to the housing and/or the pin to make up the deficiencies, other options remain viable, such as providing a better spring.

Figure 2A:
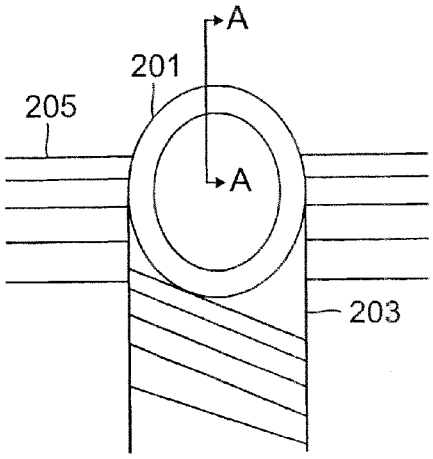
FIGS. 2*a* and 2*b* show a close-up and a cross-sectional view, respectively, of a multi-metallic canted coil spring resting in a tapered groove in accordance with aspects of the invention.
Figure 2B:
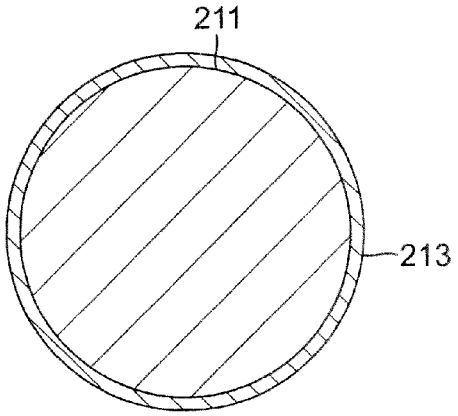

FIG. 2*a* shows a close-up of a multi-metallic canted coil spring 201 resting in a tapered groove 203 in accordance with particular embodiments of the invention. The groove 203 is disposed in a member 205, which may be a pin or a housing depending on the particular embodiment. Although the groove is shown as a tapered groove 203, in other embodiments, the groove may be of different configurations consistent with various other canted coil spring assemblies. A canted coil spring 201 rests in the groove 203, and may be situated in one of a variety of arrangements. For example, the canted coil spring 201 may be, for example, a garter-type canted coil spring which extends around the member 205, or for example, a straight canted coil spring resting in a groove 203 along a flat surface of the member, or a canted coil spring having overlapped ends that mechanically engage with one another but not necessarily welded end-to-end. FIG. 2*b* shows a cross-sectional view A-A of the multi-metallic canted coil spring 201 illustrated in FIG. 2*a*. In a preferred embodiment, the cross section of the multi-metallic canted coil spring includes a core 211 comprising a first metal with high strength properties that are more resistant to elevated operating temperatures than a typical single material conductive metal, coated or co-drawn with a metallic outer layer 213 comprising a second metal with high electrical conductivity. The formed wire is then rolled about a mandrel, either clockwise or counter-clockwise, to form a canted coil spring having a plurality of coils canted in the same direction relative to a spring centerline. (See, e.g., FIG. 7 of U.S. Pat. No. 4,826,144, the contents of which are expressly incorporated herein by reference). In an alternative embodiment, the formed wire is turned to produce a circular or non-canted spring, like ordinary helical coil springs. The non-canted spring is then mechanically canted in the same direction and post treated, such as by heating to a sufficient temperature, to anneal the spring so that it remains canted when cooled.

In one embodiment, FIGS. 2*a* and 2*b* may represent a close-up and cross-sectional views of the canted coil spring of FIG. 1. Canted coil springs that are made from multi-metallic materials can improve the utility of the locking and connecting mechanisms at elevated temperatures by blending high mechanical properties with high conductive properties. Electrically conductive canted coil springs with multi-metallic wires can be used effectively without degradation of mechanical properties or stress relaxation at elevated temperatures above 210 degrees Celsius if at least one of the metals used has high heat resistance characteristic, thereby retaining high modulus of elasticity and high tensile strength at said elevated temperatures, even if it possesses low electrical conductivity. A high strength metal, for example, an Austenitic-type stainless steel, may be used as a core in a canted coil spring, while an outer layer may comprise a metal with high conductivity and lower strength properties, such as the electrically conductive metal alloys mentioned above. If a canted coil spring with a multi-metallic configuration has a core metal with high modulus of elasticity and high tensile strength, the electrically conductive outer layer would not require the same. The stronger core metal bears and absorbs the majority of the mechanical stress applied to the multi-metallic canted coil spring, whereas the electrical conductivity of the canted coil spring would be provided by an outer layer metal. Thus, aspects of the present invention include a method for fastening a first body to a second body using a spring force and transferring electrical conductivity between the first body and the second body, said method comprising positioning a spring in a common groove defined by the first body and the second body, and sending an electrical current through the spring, said spring comprising an inner section comprising a first tensile strength property and a first conductive property and an outer section comprising a second tensile strength property and a second conductive property. In particular embodiments, the first tensile strength property is higher in value than the second tensile strength property and the second conductive property is greater than the first conductive property.

A typical multi-metallic canted coil spring wire may be made of a core of, for example, austenitic material such as 302 stainless steel, which is then covered by an outer layer of copper, silver, or other highly conductive material that may be anywhere from 1% to 50% of the wire core cross section. A typical outer layer diameter may be approximately 3% of the thickness of the core although more outer layer thickness may be required dependent on the application. Another potential core material used in a multi-metallic canted coil wire may be a carbon steel material, for example, SAE J178, which may also provide high tensile properties at elevated temperatures. An additional benefit of multi-metallic canted coil spring assembly is cost effectiveness, as steels and stainless steels are relatively inexpensive compared to electrically conductive metal alloys. Therefore, the additional processing costs associated with making multi-metallic canted coil spring wire is offset, and surpassed in most instances, by the savings accumulated from using less expensive steels and reducing the use of the more expensive alloys. Numerous options exist for the selection of core materials that include most ferrous steels and other alloys such as incoloy and hastelloy depending on the end product requirements. While copper and aluminum are the most common highly conductive materials used, the option also includes use of exotic alloys of copper and other conductive metals, such as gold. In certain embodiments, a multi-metallic canted coil wire may also be made with the outer shell made from a metal with high tensile properties, while the inner core is made from a metal having high electrical conductivity. This embodiment provides increased stiffness for the spring but has the disadvantage of higher contact resistance because the highly conductive material is in the core versus on the outer surface of the spring. This configuration can be advantageous in certain design configurations in particular where the designer might want a larger cross section area of high strength material within a certain overall wire diameter.

Thus, an aspect of the present invention is understood to include a multi-metallic coil spring comprising a multi-metallic wire comprising an inner core of a first metal having a first tensile strength and a first stiffness and an outer layer of a second metal having a second tensile strength and a second stiffness; a plurality of coils canted in a same direction relative to a spring centerline; and wherein the stiffness of the inner core is at least 3 times greater than the stiffness of the outer layer for resisting stress relaxation at elevated temperatures. The multi-metallic coil spring is also at least 3 times stiffer than a coil spring made from the same sized wire but from copper or copper alloy.

An aspect of the present invention is further understood to include a method for forming a stiff canted coil spring having electrically conductive properties comprising, forming a wire having an inner core of a first metal having a first tensile strength and a first stiffness and an outer layer of a second metal having a second tensile strength and a second stiffness, turning the wire to form a plurality of coils, wherein the plurality of coils are canted in a same direction and wherein the spring is at least 3 times more stiff than a similar canted coil spring made from the same outer layer throughout.

In one embodiment, the multi-metallic canted coil spring 201 is formed with a back angle that is greater than about 1 degree and less than about 25 degrees, so as to enable consistent deflection of the spring in the loading direction and the front angle is less than about 30 degrees. The exemplary multi-metallic canted coil spring 201 is configured to provide a characteristic force/deflection curve having a generally constant profile over a large spring deflection range, such as between about 8% to about 33% deflection range. The deflection range may further be manipulated by regulating the spacing between each spring coil of the multi-metallic canted coil spring. Further discussions regarding spring characteristics for producing generally constant force/deflection curve are disclosed in U.S. Pat. No. 4,655,462, the contents of which are expressly incorporated herein by reference.

In another alternative aspect of the present invention, the multi-metallic canted coil spring 201 is formed to exhibit preselected resilient characteristics in response to axial loading of the springs. This may be provided by controlling the back angle of the spring, which defines the trailing portion of each coil. The front angle is also controlled, preferably so that it is greater than the back angle. In a particular embodiment, the back angle may be made greater than one degree and less than about 35 degrees, and the front angle may be made less than 35 degrees. In each instance, the front angle is always greater than the back angle of the spring. Further discussions regarding spring characteristics for producing preselected resilient characteristics are disclosed in U.S. Pat. Nos. 4,824,144; 4,964,204; and 4,915,366, the contents of each of which are expressly incorporated herein by reference.

Figure 2F:
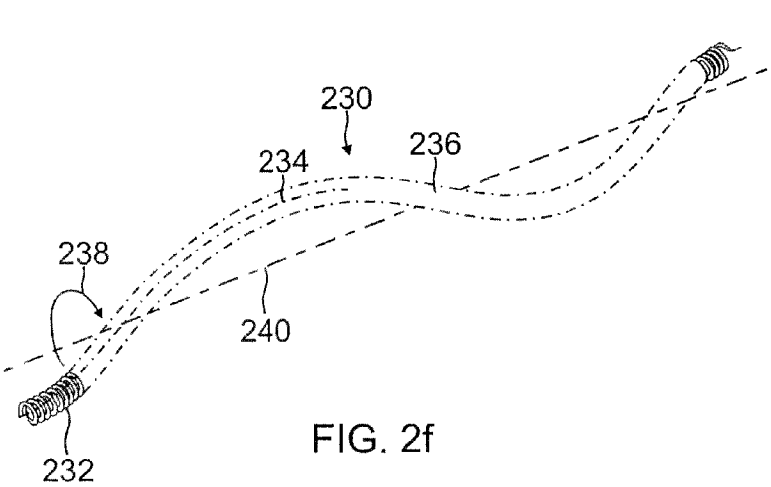
FIG. 2*f* shows a free standing multi-metallic canted coil spring that follows a helical path.
Figure 2C:
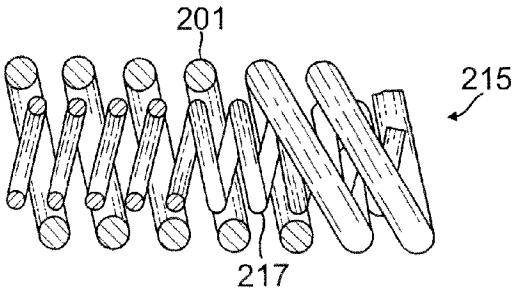
FIG. 2*c* shows sections of a spring assembly having an outer spring and an inner spring disposed relative to the outer spring and having a common spring axis.

FIG. 2*c* shows a cross-section of a multi-metallic canted coil spring assembly 215, which in one embodiment is linear and in another embodiment is a garter-type canted coil spring. The spring apparatus 215 comprises a multi-metallic coil spring 201 being an outer spring and having an inner circular or non-canted coil spring 217. In another embodiment, the inner spring 217 is a canted coil spring, which may be canted in the same direction as the outer canted coil spring or in the opposite direction. While the inner spring 217 is preferably uni-metallic, it may be made multi-metallic in the same manner as the outer multi-metallic coil spring. The spring assembly 215 having inner and outer springs, whether both are canted coil springs or just the outer spring, produces different force/deflection characteristics than a single spring. Further characteristics of inner and outer springs incorporated in a spring assembly are disclosed in U.S. Pat. No. 4,907,788, the contents of which are expressly incorporated herein by reference. Such spring assembly is useable in a connector involving a first member and a second member, such as a housing having a bore having a groove in combination with a pin, for electrical conduction. The connector may in turn be used in aerospace, automotive, oil and gas, and for various electrical transmission applications, such as in ovens, heaters, wind mills, switch racks, etc. The spring assembly is especially preferred at elevated temperatures, such as 210 degrees C. or higher, so that the high tensile strength and high modulus of elasticity of the multi-metallic spring can maintain the required mechanical stress without degradation as compared to similar springs made from typical conductive materials, such as copper or copper alloy.

Figure 2D:
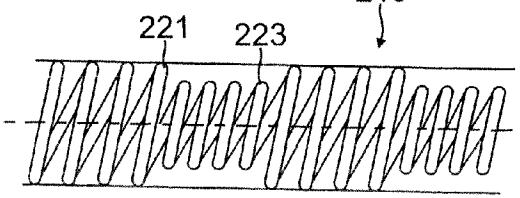
FIG. 2*d* shows a section of a spring having primary and secondary spring sections.

FIG. 2*d* shows a partial side view of yet another alternative multi-metallic canted coil spring 219 provided in accordance with aspects of the present invention. The alternative coil spring 219 is formed with different metallic layers, hence multi-metallic, and with non-uniform coil sizes. i.e., different dimensional coil sizes. In one embodiment, the spring 219 comprises a primary coil section 221 and a secondary coil section 223. The different coil sections give the spring, although made from a continuous coil, variable force and variable deflection due to the different coil sizes. The different sizes may alternate every other coils, may alternate after a few similar coil sections as shown in FIG. 2*d* so that the two outside diameter sections of the primary and secondary coil sections are outside diameter justified, are inside diameter justified, or center justified (FIG. 2*d*). Further characteristics of a spring having primary and secondary spring sections are disclosed in U.S. Pat. No. 7,055,812, the contents of which are expressly incorporated herein by reference.

Figure 2E:
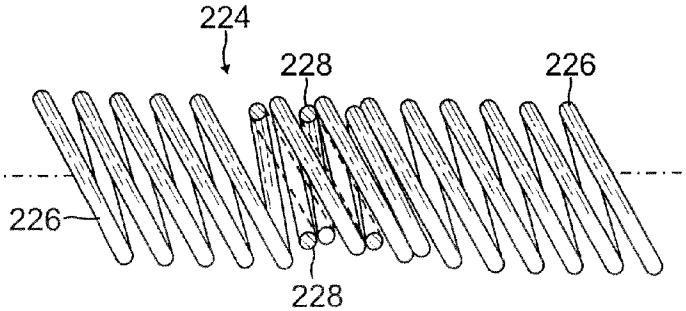
FIG. 2*e* shows a section of a spring having spring ends adapted for joining the spring length together to produce a garter-type spring.

FIG. 2*e* shows a partial side view of a multi-metallic coil spring 224 having an intermediate section 226 that differs from two end coil sections 228. The end coil sections 228 being congruent with the intermediate coil section 226 to allow them to be joined together so as to form a garter-type spring while at the same time maintaining spring characteristics at the joined location. Like other springs discussed elsewhere herein, the spring may be an axial canted coil spring or a radial canted coil spring. Further characteristics of a spring having joined ends are disclosed in U.S. Pat. Nos. 5,615,870; 5,709,371; and 5,791,638, the contents of each of which are expressly incorporated herein by reference. Hence, an aspect of the present invention is understood to include a multi-metallic canted coil spring having spring ends that allow them to be mechanically joined without welding or with welding being optional.

FIG. 2*f* shows a perspective view of a multi-metallic canted coil spring 230 in which a plurality of elliptical coils 232 have a coil centerline 234 following a helical path 236 in a clockwise manner 238 about a helical centerline 240 and the elliptical coils are wound in a clockwise manner about the coil centerline. The spring 230 is capable of forming a stable, unsupported, circular axially loadable spring. In one embodiment, the length of the canted coil spring is approximately equal to a distance or pitch, along the helix centerline necessary for one complete revolution of the helical path thereabout. Further characteristics of a torroidal spring are disclosed in U.S. Pat. No. 5,139,243, the contents of which are expressly incorporated herein by reference.

Figure 3:
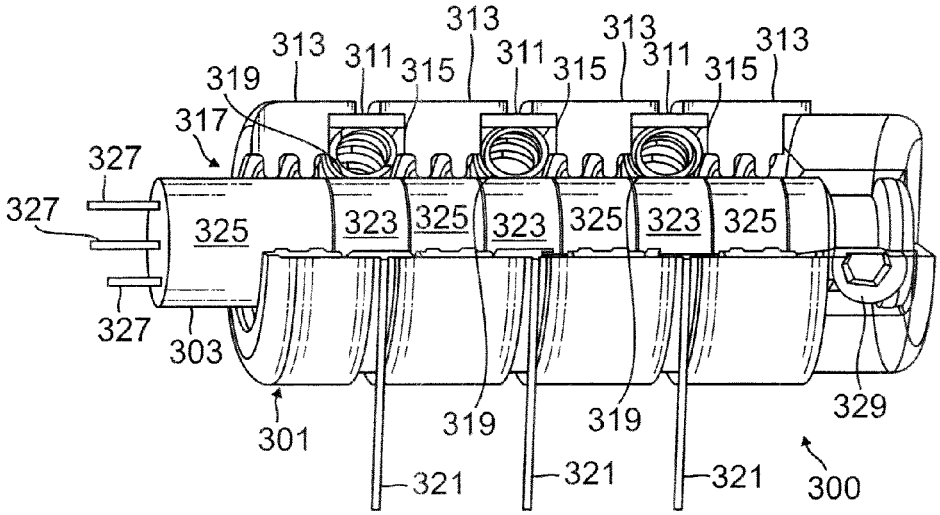
FIG. 3 is an isometric cut-away view of a multi-metallic canted coil spring assembly with electrical connectivity in accordance with aspects of the invention.

FIG. 3 shows an embodiment of a cylindrical electrical connector assembly 300 comprising an electrical connector housing 301 receiving a mating electrical connector pin 303 and having pluralities of multi-metallic canted coil springs in electrical communication between the two. In one embodiment, the housing 301 comprises electrical contact elements 311 separated from one another by non-conductive ring elements 313, which may collectively be referred to as alternating stacked of conductive and non-conductive cylindrical elements. The surface of the contact elements 311 and the side walls of the ring elements 313 form grooves 315 in a bore 317 of the housing 301 in which are retained multi-metallic canted coil springs 319, situated so as to be in constant contact with the contact elements 311. The contact elements 311 are configured to pass electrical current to and from dedicated lead wires 321 connected to each of the contact elements, the other end of the lead wires leading out of an exterior surface of the housing. In other embodiments, a bus (not shown) is used to collect the lead wires and redirect them to a controller or power source. The electrical connector pin 303 includes electrical terminals 323 spaced apart a distance corresponding to the distance between the electrical contact elements 311 of the housing and the multi-metallic canted coil springs 319. The electrical terminals 323 on the pin are similarly separated by non-conductive elements 325 to isolate the electrical signals received by each of the terminals. Each terminal 323 is connected to and communicates with a dedicated electrode lead 327 located inside a body of the pin. The electrode leads 327 transmit electrical signals between the terminals 323 on the pin and terminals on a distal end of the cable.

Figure 5:
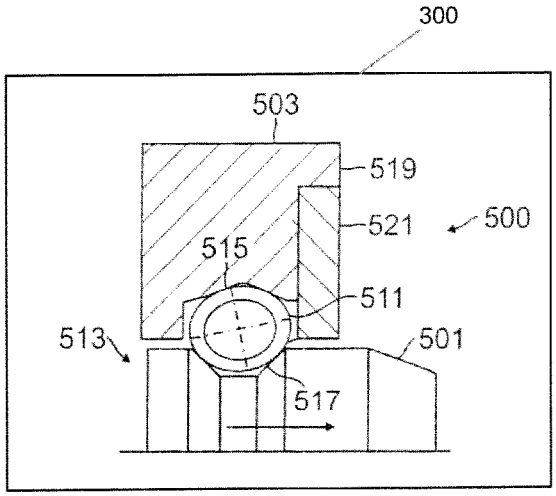
FIG. 5 is a partial cross-sectional view of a canted coil spring latching assembly using a multi-metallic canted coil spring disposed in an external pin groove mechanically interacting with a V-groove in a housing, creating an electrical connection between the housing and the pin.

The multi-metallic canted coil springs 319 are situated in the grooves 315 of the housing 301 so that a portion of each canted coil spring extends into the bore 317 of the housing. The canted coil springs 319 are assembled to ensure contact between the extending portions of each canted coil spring and the exterior surface of the pin 303 upon insertion of the pin into the bore 317 of the housing 301. The multi-metallic canted coil springs 319 are sized so that each is deflected by the pin 303 to about 5% and up to about 60% of its total radial deflection, thereby ensuring a sufficient spring contact force between the electrical contacts 311 of the housing 301 and the electrical terminals 323 of the pin. When the pin 303 is engaged within the housing 301, the electrically conductive layer of the multi-metallic canted coil springs 319 may therefore facilitate electrical communication between the electrical contacts 311 of the housing and the electrical terminals 323 of the pin. As the multi-metallic canted coil springs 319 include two metals including a steel or stainless steel core, the tensile strength and modulus of elasticity of the multi-metallic canted coil spring will not significantly lessen at high temperatures, providing for secure fastening means at elevated temperatures. Therefore, with application of a multi-metallic canted coil spring, the fastening assembly as illustrated in FIG. 3 will maintain its effectiveness at temperatures and in environments where a fastening assembly applying a canted coil spring constructed of a highly conductive alloy would fail or an electrical contact canted coil spring constructed solely from a highly conductive low melt point metal would fail or not perform satisfactorily, such as, for example, connectors for car or water bearing vessel battery terminals, wind turbines, or solar panels, indicated generically as box 350 (FIG. 5).

In some embodiments, the pin 303 may be assembled so that the pin has a smaller exterior diameter at the electrical terminals 323 than at the non-conductive portions 325 of the pin element, creating a plurality of pin grooves along the exterior of the pin where the electrical terminals are located. The pin 303 may be assembled with pin grooves for receiving the multi-metallic canted coil springs 319 upon insertion of the pin into the housing 301, thereby assuring proper positioning between the pin and the housing when fastened together. In other embodiments, the pin 303 may have a uniform exterior diameter, and proper positioning upon fastening may be facilitated by alternative means, for example, a set screw 329 for securely fixing and positioning the pin within the housing 301. Alternatively, an end holding ring or similar mechanism may be incorporated at the distal end of the connector assembly for providing secure positioning. Thus, aspects of the present invention is a cylindrical electrical connector assembly comprising a plurality of stacked alternating conductive and non-conductive cylindrical elements, comprising a plurality of canted coil springs, wherein each spring is made of an inner material having a first electrically conductive property and an outer material made up of a second electrically conductive property. In a further aspect of the present invention, each spring incorporates at least two sections having two different tensile strength properties. In one particular embodiment, the inner material is either austenitic material or carbon steel and the outer conductive material is copper, aluminum, gold, or alloys thereof.

Other in-line connectors useable with embodiments of the present invention are disclosed in co-pending Publication No. 2008/0246231, Ser. No. 12/062,895; Publication No. 2008/0255631, Ser. No. 12/100,646; provisional application No. 61/114,915 filed Nov. 14, 2008: and provisional application No. 61/159,313, filed Mar. 11, 2009, the contents of each of which are expressly incorporated herein by reference. From the foregoing references, a person of ordinary skill in the art can form in-line connectors having grooves formed by various means, seals, non-conductive rings, and conductive rings of varying shapes and geometries. These include forming an in-line connector by providing a header having pre-formed slots or cavities for receiving sets of a combination ring contact element and multi-metallic canted coil spring. The combination is inserted into the formed slots in a pre-mold header. Advantageously, the in-line connectors allow for electrical transmissions of multiple leads simultaneously by providing spaced apart electrical contacts for contacting corresponding spaced apart leads located inside a lead cable or pin.

Figure 4:
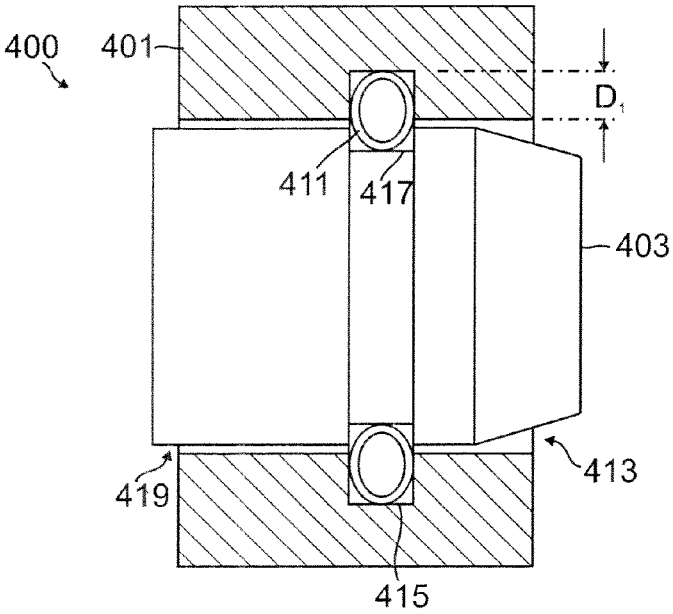
FIG. 4 is a cross-sectional view of a radial canted coil spring locking assembly using a multi-metallic canted coil spring in a rectangular groove configuration to facilitate electrical conductivity between a first and second member.

FIG. 4 shows a cross-section of a further embodiment of a fastening assembly 400 with a multi-metallic canted coil spring 411 in accordance with aspects of the invention. The particular embodiment of FIG. 4 is a locking mechanism, and includes a housing 401 with a bore 413, a pin 403 sized for insertion into the bore, and a multi-metallic canted coil spring 411. A housing groove 415 with a rectangular cross-section retains the canted coil spring 411, and has a depth D1 less than a width of the canted coil spring, so that a portion of the canted coil spring extends outwardly from the housing groove into the bore 413 of the housing 401. The groove may also be sized so that the spring 411 is retained in the groove in an interference to retain the spring in a selected orientation for subsequent loading of the spring, such as shown and disclosed in U.S. Pat. No. 5,108,078, the contents of which are expressly incorporated herein by reference. Alternatively, the groove 415 may be shaped and sized as provided in U.S. Pat. Nos. 5,082,390; 5,139,276; or 5,545,842, the contents of each of which are expressly incorporated herein by reference. A pin groove 417 along the exterior surface of the pin 403, also having a rectangular cross-section, is positioned to receive the extending portion of the canted coil springs 411. Upon insertion of the pin 403 into the housing 401, the pin and housing are locked to one another along an axis of insertion when the canted coil spring is disposed within both the housing groove 415 and the pin groove 417.

In some embodiments, a bottom surface of the housing groove 415 opposite a groove opening may be fitted with an electrically conductive material. Alternatively, a whole segment of the housing 401, for example, the entire housing segment as illustrated in FIG. 4, may be comprised of an electrically conductive material. Likewise, a portion of the pin 403, for example, the bottom surface of the pin groove 417, or the entire pin may comprise an electrically conductive material. A gap 419 between the housing 401 and the pin 403 exists for ease of insertion of the pin into the housing, allowing for minimal movement of the pin within the bore 413 of the housing in directions perpendicular to the axis of insertion. Due to the existence of the gap 419, the multi-metallic canted coil spring provides the only source of continuous contact between the housing 401 and the pin 403. Electrical current may be transmitted between the housing 401 and the pin 403 primarily through an electrically conductive outer layer of the multi-metallic canted coil spring 411. A steel core of the multi-metallic canted coil spring will facilitate effective locking of the pin within the housing, even in applications where the temperature far exceeds the order of 210 degrees Celsius. Consequently, an electrically conductive locking assembly using a multi-metallic canted coil spring may be effectively applied to uses at extreme temperatures, for example, in under-the-hood applications in an automobile, whereby both electrical conductivity and mechanical locking are preserved.

Accordingly, aspects of the present invention include a method for maintaining high latching and locking forces and electrical conductivity between a pin and a housing at elevated temperatures, such as 210 degrees Celsius or higher, by using a canted coil spring made of a first metal having high modulus of elasticity and high tensile strength and a second metal having high conductive properties. Such high modulus and tensile strength values should be in the approximate range of that of 316 S.S. (elastic modulus: 29×10^6 psi, tensile strength: 79,800 psi) and MP35N (elastic modulus: 34×10^6 psi, tensile strength: 145,800 psi). Good electrical conductivity should be in the range of copper ($0.596\times10^6$/ohm-cm or 100% IACS) and platinum ($0.0966\times10^6$/ohm-cm or 16% IACS). The stiffness of a typical canted coil spring with a heat resistant core and a highly conductive outer shell can be 3-5 times greater than a canted coil spring made solely from a copper alloy wire at elevated temperatures. In another aspect of the present invention, a method for transferring electrical current between a first member and a second member at 210 degrees Celsius or higher is provided with a groove defined by surfaces of the first member and the second member, and disposing a multi-metallic canted coil spring in the groove, said multi-metallic canted coil spring functions as a conduit for electrical conduction between the first member and the second member. In yet a further aspect of the present invention, a lead cable is connected to the housing 401 for carrying electrical current across a disconnectable interface.

FIG. 5 shows a cross-section of an electrically conductive latching connector 500 with a multi-metallic canted coil spring 511 in a latched position in accordance with aspects of the invention. The latching connector 500 includes a pin 501 latched within a bore 513 of a housing 503 by a multi-metallic canted coil spring 511 located in the housing bore. In FIG. 5, the assembly is configured cylindrically, and only half of the connector assembly is illustrated, as indicated by a centerline at the bottom of the illustration. The multi-metallic canted coil spring 511 is a radial canted coil spring, and rests in a V-groove 515 in the bore 513 of the housing 503, with a portion of the canted coil spring extending out from the groove and into the housing bore. The outside diameter of the canted coil spring 511 is larger than the housing groove diameter, so that the canted coil spring exerts a force in a direction radially outward of an axis of insertion of the pin 501 into the housing 503. In this manner, an outside layer of the canted coil spring 511 is always in direct contact with surfaces of the housing groove 515. In alternative embodiments, an axial canted coil spring may be used in combination with different bore surfaces, such as inclined or angled surface, to exert component forces, including a radial spring force, to latch the pin to the housing.

When the pin 501 is inserted into the housing bore 513, and a pin groove 517 is aligned with the housing groove 515, with the multi-metallic canted coil spring 511 resting therebetween, the pin 501 and housing 503 are latched together. Furthermore, the outside layer of the multi-metallic canted coil spring 511 comes into direct contact with the surface of the pin groove 517 upon latching. The configuration of the V-groove 515 in the housing 503 affects the positioning of the canted coil spring 511 upon insertion and removal of the pin 501 into and out of the housing bore 513. In the latching assembly of FIG. 5, the canted coil spring 511 causes retention of the pin 501 within the housing bore 513, but the change in positioning of the canted coil spring caused by the V-groove 515 in the housing 503 allows for release of the latching mechanism when a threshold amount of force is applied in opposite directions upon the housing and the pin. As such, the retention level of a latching assembly is lower than the retention level of a locking assembly, for example, the assembly of FIG. 4.

Figure 5A:
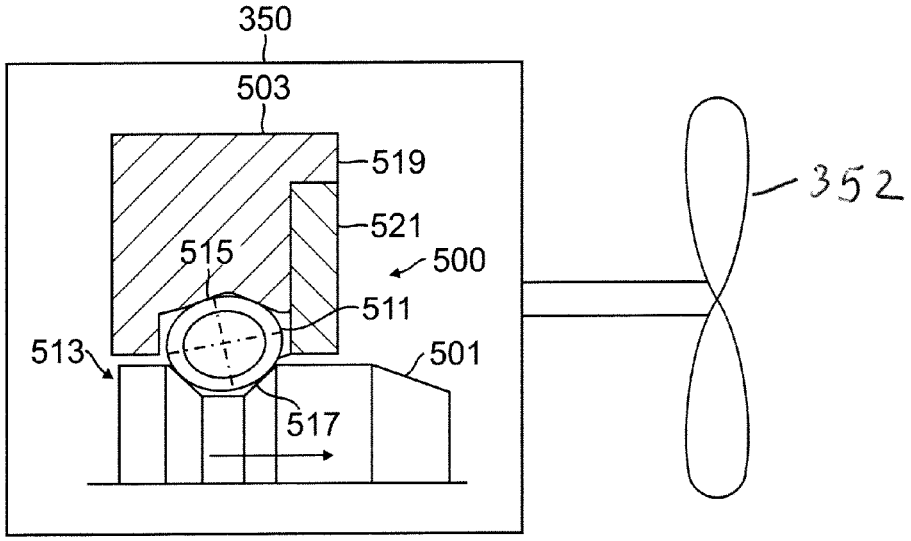
FIGS. 5*a* and 5*b* show the canted coil spring latching assembly of FIG. 5 attached to a wind turbine and to a battery of a car or a water bearing vessel, respectively.
Figure 5B:
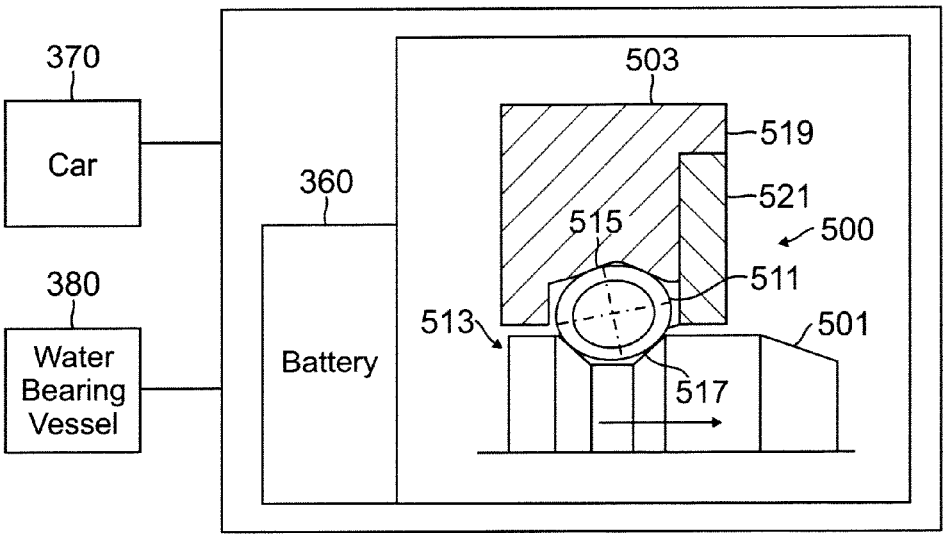

As the outside layer of the multi-metallic canted coil spring 511 is in direct contact with both the housing 503 and the pin 501 while the assembly is engaged, the layer acts as an efficient electrical contact between the housing and the pin if it is comprised of an electrically conductive material, and is simultaneously contacting electrically conductive elements on both the housing and the pin. Furthermore, the surface of the housing V-groove 515 and the bottom of the pin groove 517 may be plated with electrically conductive metals to improve contact performance and reliability. An electrical pathway is thereby' facilitated when the latching assembly is engaged, and electrical current may be transmitted between the housing 503 and the pin 501 through the outside layer of the multi-metallic canted coil spring 511. As has been consistent with previous embodiments, the core of the multi-metallic canted coil spring 511 is comprised of a material with higher modulus of elasticity and greater tensile strength so that the structure and mechanical properties of the canted coil spring is maintained even at elevated temperatures. Therefore, the latching mechanism of the assembly of FIG. 5 will continue to work and provide the desired electrical conductivity even if the assembly is used at elevated temperatures. The assembly of FIG. 5 can be used as connectors for car batteries, wind turbines, water bearing vessels or solar panels. For example, FIG. 5*a* shows the assembly of FIG. 5, indicated generically as 350, disposed in a wind turbine comprising at least one rotatable blade 352. FIG. 5*b* shows the assembly of FIG. 5 connected to a battery terminal 360, which can be located in a car 370 or alternatively to a water bearing vessel 380.

Various cost effective measures may also be taken in certain embodiments of the invention. For example, as has been discussed above, the assembly costs of multi-metallic canted coil springs is reduced as compared to electrically conductive canted coil springs using a single conductive alloy due to the relatively low cost of the core materials in the multi-metallic canted coil springs as compared to electrically conductive alloys. Further, as can be seen in FIG. 5, the housing may be comprised of two separate members, where the housing groove is formed in an open face of a first member 519, before a second member 521 is connected to the first member, the second member comprising a final side wall of the housing groove 515, thereby completing construction of the housing groove. Such an assembly procedure is an alternative to machining, etching, or casting the housing groove 515 from inside the housing bore 513, and can be executed with more conventional, more accurate, and more cost effective machining methods.

Figure 6:
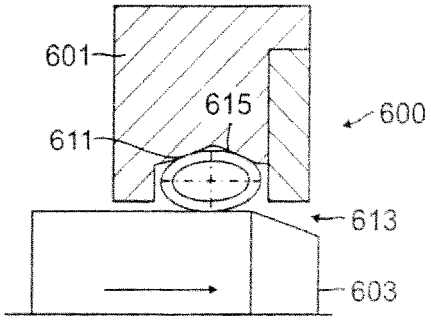
FIG. 6 is a partial cross-sectional view of a canted coil spring holding assembly whereby a multi-metallic canted coil spring is disposed in a housing V-groove and a non-grooved pin contacts the canted coil spring upon insertion, creating an electrical connection.

FIG. 6 shows a cross-section of an electrically conductive holding connector assembly 600 with a multi-metallic canted coil spring 611 in accordance with aspects of the invention. The holding assembly of FIG. 6 is structured much like the latching assembly of FIG. 5, both being comprised of a housing 601 with a bore 613, a multi-metallic canted coil spring 611 positioned within a V-groove 615 in the bore of the housing, and a pin 603 sized for insertion into the housing. A portion of the multi-metallic canted coil spring 611 extends out of the V-groove 615 and into the housing bore 613. However, the pin 603 in FIG. 6 does not include a pin groove, instead having a flat exterior surface. Therefore, upon insertion of the pin 603 into the bore 613 of the housing 601, the multi-metallic canted coil spring 611 is compressed by the exterior surface of the pin, but there is no latching or locking mechanism between the housing and the pin, as there exists no opposing pin groove for the canted coil spring to re-expand and come to rest within. The housing 601 and the pin 603 are held together by the frictional forces derived from the compression of the canted coil spring 611 between the V-groove 615 and the surface of the pin. The retention level of a holding assembly, such as the assembly in FIG. 6, is lower still than the retention levels of both locking assemblies and latching assemblies. While the pin 603 is secured in place within the housing bore 613 when no forces are applied to the pin or the housing 601, only a relatively smaller amount of force applied to the housing and the pin in opposite directions will cause the holding assembly to separate.

As seen with prior embodiments, compression of the multi-metallic canted coil spring 611 upon engagement of the holding assembly creates an arrangement where the canted coil spring acts as an intermediary between the housing 601 and the pin 603. If the multi-metallic canted coil spring 611 comes in contact with electrically conductive surfaces on both the housing 601 and the pin 603 simultaneously, an electrical pathway between the housing and the pin is created primarily through the electrically conductive outer layer of the multi-metallic canted coil spring. In some embodiments, only a portion of the pin 603 may be electrically conductive, for example, an electrically conductive ring positioned along the exterior surface of the pin, an example of which was illustrated in FIG. 3. In these embodiments, electrical conductivity between the housing 601 and the pin 603 may only be facilitated when the pin is held at a certain position in relation to the housing thereby creating a switch. In other embodiments, the entire pin 603 may be made from electrically conductive material, thereby facilitating electric connectivity between the housing 601 and the pin upon engagement, regardless of the position of the pin within the housing. Thus, an aspect of the present invention is a connector configured to operate at elevated temperatures, in the order of 210 degrees C. and higher using a multi-metallic canted coil spring for electrical conduction between a housing and a pin, or a first member and a second member, and wherein the pin is axially insertable into a bore of the housing at any axial position so that the spring contacts the surface of the pin.

Figure 7:
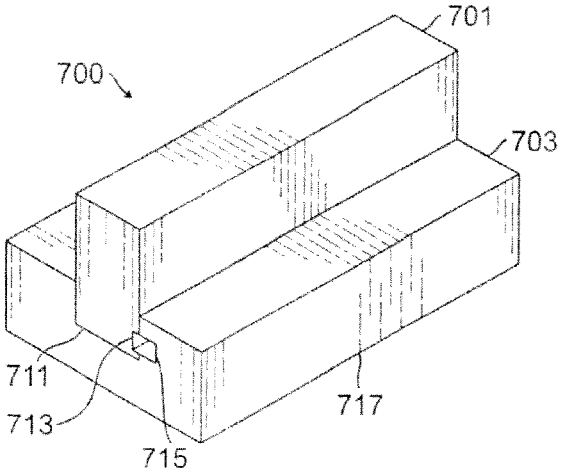
FIG. 7 shows a canted coil spring assembly using a multi-metallic canted coil spring in which a straight canted coil spring is disposed between two longitudinal members, creating electrical conductivity between the two members upon assembly of the two members.

FIG. 7 is a perspective view of one embodiment of an electrically conductive multi-metallic canted coil spring assembly 700 with the canted coil spring disposed between two longitudinal members in accordance with aspects of the invention. The assembly includes a male member 701 and a female member 703 with a slot 711 sized to allow insertion of the male member. A first longitudinal groove 713 is disposed on one face of the male member 701, the groove positioned in the slot upon assembly of the male member with the female member. A second longitudinal groove 715 is disposed in the slot of the female member 703, the second longitudinal groove aligned with the first longitudinal groove 713 when the male member 701 is fully inserted into the female member at assembly. A multi-metallic canted coil spring is retained in the second longitudinal groove 715, which is constructed with a depth less than the diameter of the canted coil spring, so that a portion of the canted coil spring extends outward of the second longitudinal groove 715.

Upon assembly of the male member 701 with the female member 703, the extending portion of the multi-metallic canted coil spring engages the first longitudinal groove 713, fastening the male member and the female member. Other embodiments may retain the multi-metallic canted coil spring in the male member 701 rather than the female member 703 when the two members are not assembled together. Furthermore, it is appreciated that an interior shape of each longitudinal groove determines the strength of the fastening assembly, that is, whether the male member 701 and female member 703 lock, latch, or hold when assembled together. The extent of locking and holding can also be determined by the groove surfaces, i.e., degree of incline, as well as spring material, spring front and back angles.

The male member 701 and female member 703 are both fitted with electrically conductive material that are both in constant contact with the electrically conductive outer surface of the multi-metallic canted coil spring when the two members are assembled together. In some embodiments, a portion of an interior side wall of each longitudinal groove may be fitted with electrically conductive material, whereby electrical connectivity is facilitated between the two members upon assembly. Such embodiments may increase cost effectiveness, as the amount of relatively expensive electrically conductive alloys utilized is minimized. Other embodiments may include electrically conductive sections or portions, for example, the shaded portions 717 of FIG. 7. In such embodiments, electrical conductivity between the male member 701 and the female member 703 may still be facilitated, even when the male member is improperly inserted into the female member. For example, in the embodiment of FIG. 7, the male member 701 may be inserted into the female member 703 with the male member being slightly displaced along the longitudinal axis, causing the electrically conductive section of the male member to not come in contact with the electrically conductive section of the female member. However, even in such situations, electrical conductivity may nonetheless be established if both sections are in contact with the multi-metallic canted coil spring, as the electrically conductive outer layer of the canted coil spring may act as an electrical conduit between the two electrically conductive sections.

Further, if the multi-metallic canted coil spring is constructed of a core having high tensile strength and/or modulus of elasticity, the range of application of the fastening assembly of FIG. 7 may be increased. The multi-metallic canted coil spring will resist permanent deformation as stress relaxation at elevated temperatures, and both the fastening properties and the electrical conductivity of the assembly may remain consistent, even if used in environments prone to such elevated temperatures.

Figure 8A:
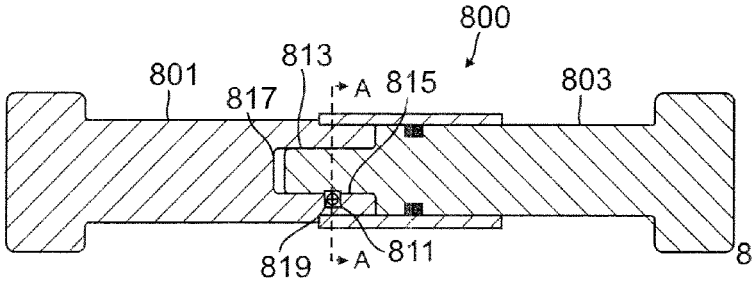
FIGS. 8*a*-8*d* show a rotary locking mechanism with radial disassembly means using a multi-metallic canted coil spring disposed in a groove in a housing, whereby electrical connectivity between the housing and an inserted pin is facilitated through the canted coil spring.

FIGS. 8*a*-8*d* show a rotary locking mechanism 800 with quick radial disassembly means using an electrically conductive multi-metallic canted coil spring 811 in accordance with aspects of the invention. FIG. 8*a* is a cross-sectional view of a cylindrical housing 801 and a cylindrical piston 803 in an assembled position. The piston 803 comprises a piston tongue 813, and a piston groove 815 on a flat side of the piston tongue. The housing 801 comprises a slot 817 configured to receive the piston tongue 813, and a housing groove 819 in one face of the slot. A multi-metallic canted coil spring 811 is retained in the housing groove 819, and locks the housing 801 and the piston 803 together when the piston is inserted into the housing so that the piston groove 815 and housing groove 819 are aligned.

Figure 8B:
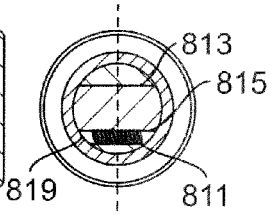

FIG. 8*b* is a section A-A of FIG. 8*a*, showing the manner in which the multi-metallic canted coil spring 811 is retained in the housing groove 819 and held by the piston groove 815. In one embodiment, there is only one correct assembly orientation, as locking action would not occur if the piston 803 was rotated 180 degrees axially with respect to the housing 801, which would pose alignment issue for the housing groove 819 and the piston groove 815. In embodiments where electrical conductivity between the piston 803 and the housing 801 are desired, an electrically conductive outer layer of the multi-metallic canted coil spring 811 serves as a contact point between the housing and the piston. For example, only the piston tongue 813 or a bottom panel of the piston tongue, for example, an inner panel of the piston groove 815, may be electrically conductive, whereby the multi-metallic canted coil spring 811 makes contact with the electrically conductive material upon alignment of the piston groove with the housing groove 819. This completes an electrical connection between the housing 801 and the piston 803 only upon locking of the mechanism, as an electrical connection which would not be completed had the piston been inserted into the housing in the alternate orientation discussed above.

Figure 8C:
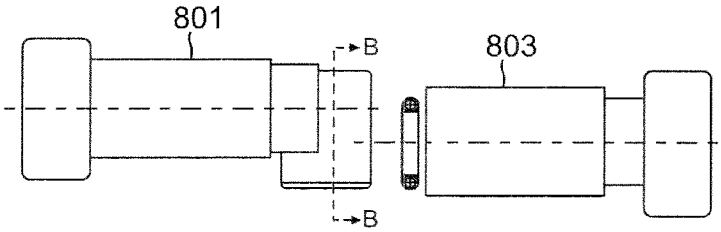
Figure 8D:
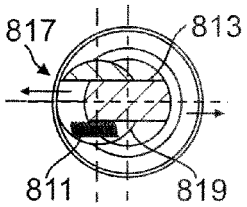

FIG. 8*c* is a side view of the disassembly means of the locking mechanism, where the piston 803 is being radially separated from the housing 801. FIG. 8*d* is a B-B sectional view of FIG. 8*c*. Both figures show the piston 803 and the housing 801 sliding away from each other to permit separation of the housing from the piston and consequent disassembly of the locking mechanism. As disassembly through pulling the housing 801 and piston 803 in opposite directions along the axis of insertion is ineffective with this locking mechanism, radial disassembly in the fashion illustrated is the only method of disassembly available for this particular embodiment of the invention. However, if a canted coil spring comprised of only an electrically conductive alloy is used in the locking mechanism, rather than a multi-metallic canted coil spring, the mechanical properties of the canted coil spring may degrade in high temperature applications, and the locking mechanism may weaken, possibly leading to undesired axial separation. The use of a multi-metallic canted coil spring with a core having high tensile properties and high modulus of elasticity at elevated temperatures in the locking assembly eliminates the possibility of mechanical failure at high temperatures, thus increasing the range of applications to which the locking assembly may be used.

Figure 9A:
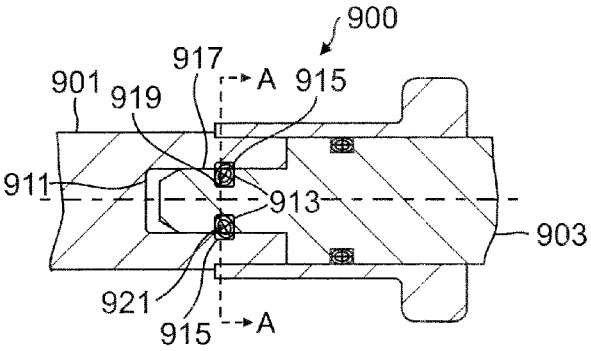
FIG. 9*a*-9*b* show an alternative embodiment of a rotary locking mechanism with quick radial disassembly means, with two multi-metallic canted coil springs disposed in grooves in a pin, where the canted coil springs create electrical connectivity between the pin and a housing which the pin is inserted into and fastens thereto.
Figure 9B:
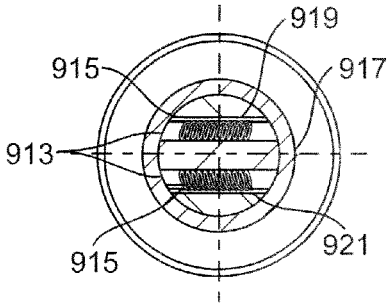

FIGS. 9*a*-9*b* show an alternate embodiment of a rotary locking mechanism 900 with quick radial disassembly means using electrically conductive multi-metallic canted coil springs in accordance with aspects of the invention. In some embodiments, FIGS. 9*a*-9*b* may represent a modified version of the invention presented in FIGS. 8*a*-8*d*, with two differences being the use of two lengths of multi-metallic canted coil springs, and the retention of the multi-metallic canted coil springs in piston grooves running along surfaces of the piston tongue rather than in housing grooves of the housing slot.

FIG. 9*a* shows a cross-sectional view of a housing 901 and a piston 903 in an assembled position. The housing 901 and the piston 903 are locked together upon insertion of the piston into the housing slot 911, and alignment of the piston grooves 913 with the housing grooves 915. In some embodiments, locking may be achieved regardless of axial orientation of the piston 903 in relation to the housing 901, where locking occurs so long as a piston tongue 917 is fully inserted into the housing slot 911.

FIG. 9*b* shows section A-A of FIG. 9*a*. In the embodiment as illustrated, electrical conductivity may be facilitated between the housing 901 and the piston 903 through a first multi-metallic canted coil spring 919 and a second multi-metallic canted coil spring 921. In these embodiments, as had been seen with regards to FIGS. 8*a*-8*d*, the housing 901 and piston 903 may be fitted with electrically conductive panels or surfaces which come into contact with an electrically conductive outer layer of the multi-metallic canted coil springs 919 and 921 upon locking. Contact points between the multi-metallic canted coil springs 919 and 921, the housing 901, and the piston 903 may facilitate electrical communication between the housing and the piston. Furthermore, in embodiments including more than one multi-metallic canted coil spring, a different electrical communication pathway may be established between the housing 901 and the piston 903 for each individual multi-metallic canted coil spring. For example, the first multi-metallic canted coil spring 919 may be attached to a first electrical lead located in the piston, and the second multi-metallic canted coil spring 921 may be attached to a second electrical lead, also located in the piston. Upon assembly, a first housing lead in a first housing groove may come into contact with the first multi-metallic canted coil spring 919, while a second housing lead in a second housing groove may come into contact with the second multi-metallic canted coil spring 921. As a result, two independent electrical current paths may simultaneously be transmitted through the two separate multi-metallic canted coil springs.

In some embodiments, different insertion orientations of the piston 903 into the housing 901 may also lead to variations in electrical connectivity, which may be utilized in various different applications. For example, in the embodiment illustrated in FIGS. 9*a*-9*b*, rotating the piston 903 axially 180 degrees in relation to the housing 901 and inserting the rotated piston into the housing would cause the first multi-metallic canted coil spring 919 to come in contact with the second housing lead, and the second multi-metallic canted coil spring 921 to come in contact with the first housing lead, creating an alternate connection scheme which may be utilized in various different applications.

As with the previous embodiments discussed, the multi-metallic construction of the canted coil springs 919 and 921 allow for use of the locking assembly in extreme environments, namely environments with elevated temperature levels, such as temperatures above 210 degrees Celsius, for example 250-300 degree Celsius. With a core of more heat resistant steel or stainless steel material, the mechanical performance of the multi-metallic canted coil springs 919 and 921 will not weaken at the elevated temperatures, and effective locking and electrical conductivity are both maintained.

Figure 10:
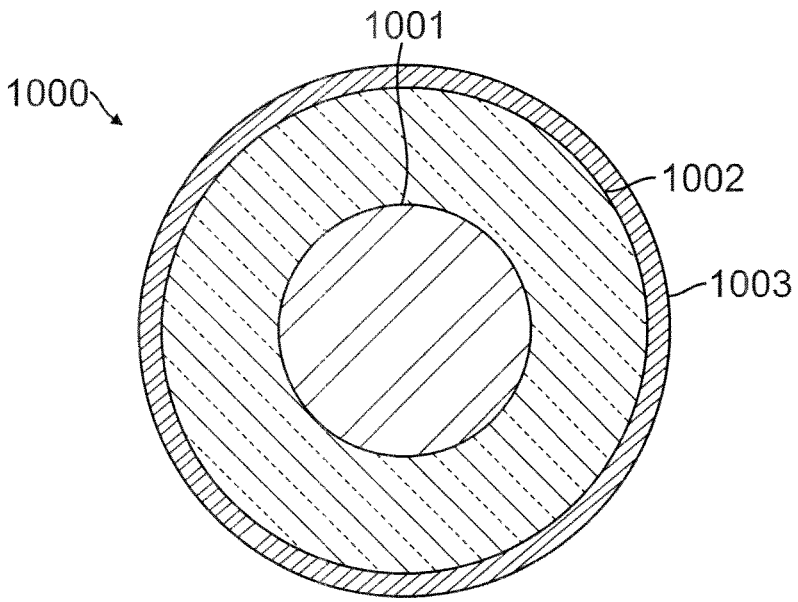
FIG. 10 shows a cross sectional view of a multi-metallic canted coil spring comprising three components, layers or sections, including an inner core, a secondary layer, and an outer layer.

FIG. 10 shows a cross sectional view of a multi-metallic canted coil spring 1000 consisting of three components; an inner core 1001, a secondary layer 1002, and an outer layer 1003. Such multi-metallic canted-coil spring may consist of an inner core 1001 made from a high modulus and high tensile strength steel, which is configured to withstand elevated temperatures, such as stainless steel or high alloy steel, a secondary layer 1002 made from a highly conductive metal such as copper, cooper alloy and aluminum, and a outer layer 1003 made from a highly corrosion resistant metal such as titanium, silver, platinum-iridium, rhenium, and palladium alloys.

In an exemplary embodiment, the canted coil spring 1000 having multi-layers is made from cladding the outer layers. In a particular embodiment, the inner core is made from an austenitic-type steel, the middle layer is made from a conductive alloy cladding layer, and the outer layer is a corrosion resistance or a wear resistant cladding layer. For example, the inner core may be made from a high modulus and high tensile strength steel, the middle layer from copper, aluminum, or their alloys, and the outer layer from tin, silver, nickel, palladium, platinum-iridium, or various types of palladium alloys.

Thus, an aspect of the present invention is a canted coil spring made from a multi-metallic wire having multiple cladding layers over a core wire; said multi-metallic spring being positioned in a groove of a housing and biasing against a groove of a pin, such as that shown in the various figures included herein. In one embodiment, the outer-most cladding layer is selected based on operating temperature of the connector that the multi-metallic spring is to operate. For example, tin may be selected for temperatures of up to about 125° C.; silver for temperatures of up to about 150° C., nickel for temperatures of up to about 210° C., and palladium for temperatures of up to about 225° C. The cladding can range from a radial thickness of about 5 microns to about 30 microns and higher depending on the requirements of the particular application. For example, in corrosion resistant applications, 5 microns may be suitable but in applications where wear resistant is a factor, then a higher thickness is more appropriate.

Figure 11:
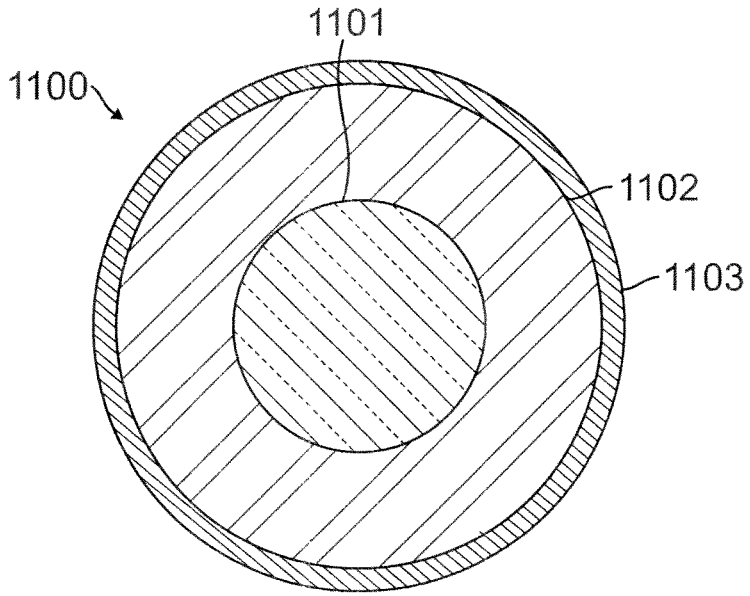
FIG. 11 shows a cross sectional view of a multi-metallic canted coil spring comprising of three components, layers or sections, including an inner core, a secondary layer, and an outer layer with a different arrangement from that in FIG. 10.

FIG. 11 shows a cross sectional view of a multi-metallic canted coil spring 1100 consisting of three components; an inner core 1101, a secondary layer 1102, and an outer layer 1103 with a different arrangement from that in FIG. 10. In the present invention, the inner core 1101 may be made from a highly conductive metal such as copper. The secondary layer 1102 may be made from a high modulus and high tensile strength steel to provide increased stiffness over such multi-metallic wire consisting of said high tensile strength steel as the inner core material since cylindrical stiffness is greater than that of a rod. The outer layer 1103 may be made from a highly corrosion resistant metal, such as titanium or silver, to name a few. Other combinations could be made to other applications that provide special requirements such as an outer layer made from a bone compatible material, a secondary layer from a noble metal to prevent galvanic corrosion such as platinum, and an inner core made of a high modulus material like steel. The springs of FIGS. 10 and 11 may be used in the manner and fashion as discussed above with reference to FIGS. 1-9 or for implantable medical applications. Advantages of coating a multi-metallic wire with a noble metal are further discussed in co-pending application Ser. No. 12/102,626, filed Apr. 14, 2008, the contents of which are expressly incorporated herein by reference as if set forth in full. Furthermore, the middle layer and out layer may added by coating or plating or by cladding.

Figure 12:
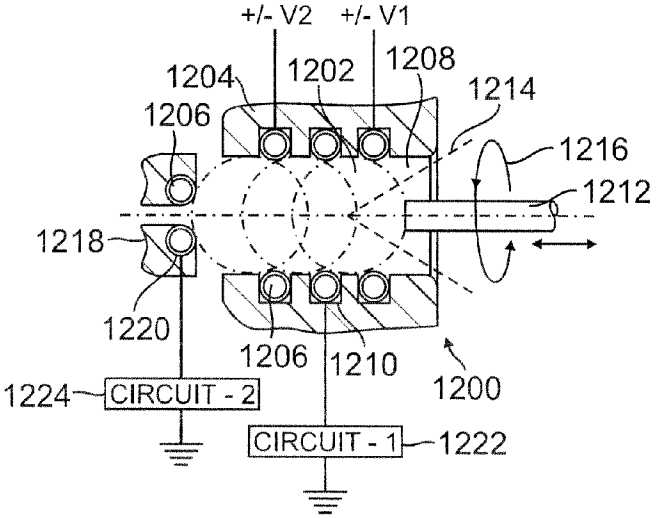
FIG. 12 shows a connector adapted for joining two different circuits.

FIG. 12 is a connector 1200 having a ball joint 1202 for use with a housing 1204 having a plurality of multi-metallic canted coil springs 1206. As shown, the housing 1204 comprises a cavity 1208 comprising a plurality of grooves 1210 having a desired side and bottom wall configuration for accommodating the springs 1206, which may be configured so that the ball joint is held, locked, or latched to the housing, as discussed elsewhere herein and in US Publication No. 2008/0053811, Ser. No. 11/869,929, for example, the contents of which are expressly incorporated herein by reference. The connector 1200 further comprises a stem 1212 attached to the ball joint 1202, which is movable to selected conical angles illustrated by the arrows 1214, 1216. A second housing 1218 spaced from the first housing 1204 is provided, which may be spatially separated or connected by a non-conducting layer (not shown). The second housing 1218 comprises a groove 1220 comprising a multi-metallic coil spring 1206 and in other embodiments a plurality of multi-metallic coil springs.

As shown, the first housing 1204 is in electrical communication with a first circuit 1222 and the second housing 1218 is in communication with a second circuit 1224. In a particular embodiment, the first circuit 1222 is connected to one of the multi-metallic springs 1206 located in the first housing 1204 and the second circuit 1224 is connected to the canted coil spring 1206 located in the second housing 1206. Electrical communication between the first circuit 1222 and the second circuit 1224 is provided when the ball joint 1202 is placed in simultaneous contact with the multi-metallic coil springs in both housings 1204, 1218. In one example, the connector 1200 is used for an electrical transmission application having a service temperature of about 210 degrees Celsius or higher. Because of its physical characteristics, which comprise a layer having high tensile strength and high modulus of elasticity in the order of about 3-5 times stiffer than that of a comparable single layer spring made of copper or copper alloy, the connector 1200 is capable of continued service without stress relaxation to the springs due to the high temperature that can otherwise cause reduction in electrical contact interface for typical conductive springs made from copper or copper alloy. In alternative embodiments, the first circuit 1222 is connected to the stem 1212 or directly to the ball joint 1202.

Thus an aspect of the present invention is understood to include a connector having a ball joint in contact with a multi-metallic coil spring, which is disposed in a groove and in contact with a housing, and wherein electrical communication flows between the housing and the ball joint through the multi-metallic coil spring. In further embodiments, the groove is located in the housing and has a bottom surface and two wall surfaces, which may be tapered or slanted, flat, or V-bottom.

Figure 13:
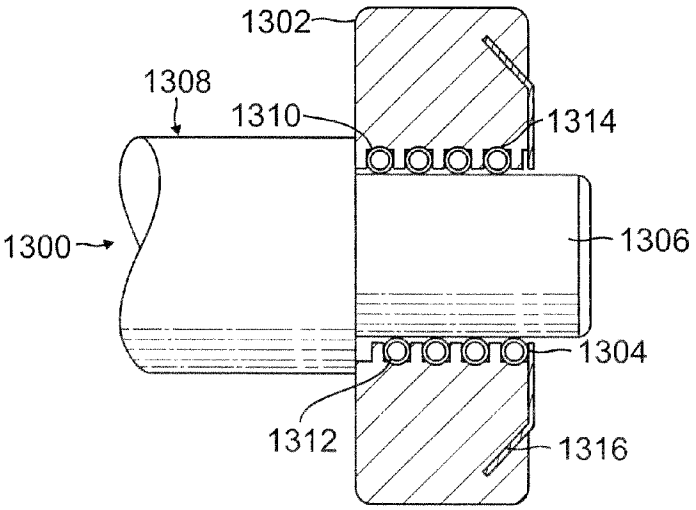
FIG. 13 shows an alternative connector having a plug head projecting into a bore of a receiving housing.

FIG. 13 is a partial cross-sectional side view of an electrical connector 1300 comprising a female connector housing 1302 having a through bore 1304 for receiving a plug head 1306 of an electrical plug 1308. The connector 1300 is designed for electrical transmission between an electrical terminal connected to or located in the housing 1302 and an electrical terminal connected to or located in the electrical plug 1308. A plurality of grooves 1310 are formed in the bore 1304 of the housing 1302 for accommodating a plurality of multi-metallic canted coil springs 1312. Each of the grooves 1310 comprises two side walls and a bottom wall, which may be a tapered bottom wall, a V-bottom wall, or a flat bottom wall. The sides walls may be vertical (i.e., perpendicular to the axis of the plug) or may be tapered to control the positions of the springs inside the groove, as discussed elsewhere herein. In one application, the grooves are not circular or circumferential but instead have defined lengths. Thus, as shown in FIG. 13, eight individual groove lengths are formed on the interior surface of the female housing. The springs 1312 are sized and dimensioned to fit within the grooves and are sufficiently wide to project into the bore.

In one embodiment, a connecting lug 1314 comprising one or more lug ends 1316 is used as an electrical terminal for the housing 1302. Wires (not shown) are formed connecting the lug ends 1316 to the multi-metallic springs 1312, which are in contact with the plug head 1306. In a particular application, the plug head 1306 is conductive and is in electrical communication with a lead cable or wire (not shown). In an electrical transmission application, electricity or signals may conduct from, to, or between the plug head 1306 and the lug ends 1316 by way of or through the plurality of the multi-metallic canted coil springs 1312.

Figure 14:
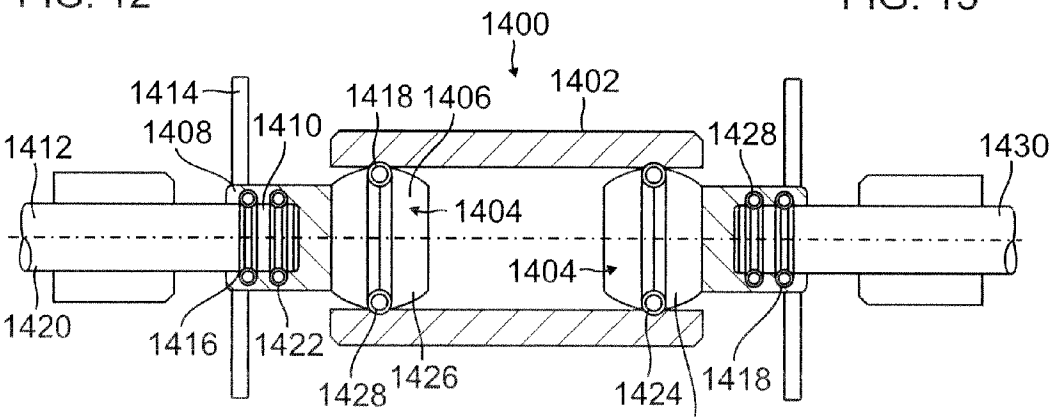
FIG. 14 shows a connector having a plurality of ball joints.

FIG. 14 is still yet another connector provided in accordance with aspects of the present invention, which is generally designated 1400. In the embodiment shown, the connector 1400 comprises a circumferential housing 1402 and two ball connectors 1404. The ball connectors 1404 each comprises a ball joint 1406 and a receiver 1408 comprising a cavity 1410 for receiving a conductor pin 1412. A tab or flange 1414 is optionally incorporated to provide a gripping point for moving the ball connector 1404 axially either into the housing 1402, out the housing, or so that the ball joint 1406 electrically engages the housing 1402, as further discussed below. The flange 1414 also functions as a physical stop to prevent over insertion of the ball joint connector into the housing.

In one embodiment, the conductor pins 1412 engage the two respective receivers 1408 and are held engaged by one or more multi-metallic canted coil springs 1416 positioned in one or more grooves 1418. In other embodiments, the conductor pins 1412 are fixedly secured to the receivers, such as by welding or formed as a unitary piece. The ball joints 1406 are in turned engaged to the housing by a respective canted coil spring 1406 positioned in a respective groove in the housing. In other embodiments, the ball joints are held by two or more multi-metallic canted coil springs located in the housing.

Electrical conductivity through the connector 1400 may flow as follows: through the first conductor pin, through the first set of springs 1422, through the first ball joint 1426, through the first housing multi-metallic spring 1428, through the housing 1402 by way of leads or cables (not shown), embedded or externally mounted, through the second housing multi-metallic spring 1424, through the second ball joint 1426, through the second set of springs 1428, and to the second conductor pin 1430.

Other connectors having axially movable components held together by multi-canted coil springs are disclosed in Ser. No. 12/329,870, filed Dec. 8, 2008, the contents of which are expressly incorporated herein by reference. Connectors having ball joints that are useable with the present invention are also disclosed in Ser. No. 61/097,076, filed Sep. 15, 2008, the contents of which are expressly incorporated herein by reference.

Applications of the preferred embodiments of the present invention are understood to include multi-metallic canted coil springs used in combination with connectors to enable adequate and sufficient electrical transmission at elevated temperatures without stress relaxation by providing a working spring having adequate electrical conductivity properties, high tensile strength, and high modulus of elasticity to withstand elevated temperatures. Said multi-metallic canted coil springs are preferably three or more times stiffer than a single material conductive spring made from copper or copper alloy.

Although only a limited number of fastening assemblies using multi-metallic canted coil springs have been specifically described and illustrated herein, many modifications and variations should be apparent to those skilled in the art. For example, different materials exhibiting similar properties as the properties disclosed may be used to construct the multi-metallic canted coil springs without deviating from the spirit and scope of the present invention. Furthermore, aspects or features discussed specifically for one embodiment or figure may used or incorporated in another embodiment or figure discussed elsewhere herein provided the functions of the modified new combination are compatible and consistent with the described primary functions. Accordingly, it is to be understood that fastening assemblies using multi-metallic canted coil springs may be embodied other than as specifically described herein.

Furthermore, the present invention of multi-metallic canted-coil springs is not limited to only consisting of two different metallic components. Multi-metallic canted-coil springs may comprise of three or more metallic components or layers with such components or layers arranged in an order as to provide an advantage in performance or performance conditions that is unobtainable through the use of a multi-metallic canted-coil spring consisting of two metallic components. For example, a multi-metallic canted-coil spring consisting of three metallic components as follows: 1) a core material with a high modulus and high tensile strength such as steel, stainless steel or a high alloy steel; 2) a second layer of a highly conductive metallic such as copper; and 3) a third layer of a highly corrosion resistant metal such as titanium. This combination may be used for industrial applications. A similar combination of metals can be applied to multi-metallic canted-coil springs used in medically implantable devices. Such components can be as follows: 1) an inner core made from an austenitic material such as 316 L stainless steel or MP35N to provide a high modulus of elasticity and a high tensile strength; 2) a second inner layer made from titanium to provide corrosion resistance; and 3) an outer layer made from a noble metal such as platinum or a noble metal alloy such as platinum iridium to prevent galvanic corrosion, all materials being bio-compatible.

In addition, the present invention of the multi-metallic canted-coil spring can allow for the use of such canted-coil spring and corresponding assemblies at extremely small scales. At such small sizes, strength is crucial for canted-coil spring performance. In current-carrying applications, the finer size of highly conductive canted-coil springs is limited due to the lower strength of noble metals typically used for such applications. This in turn leads to frequent failures because of inadequate strength in making small-scale springs from low strength materials. Likewise, the multi-metallic canted coil spring in accordance with aspects of the present invention may be used for transferring electrical current between a stationary and a rotating member, such as between a stator and a rotor disclosed in US Publication No. 2005/0242910. Ser. No. 11/113,527, the contents of which are expressly incorporated herein by reference.

However, multi-metallic canted-coil springs allow the spring size to be significantly decreased by drastically increasing the strength of comparable springs, namely by providing a high modulus component within such multi-metallic canted-coil spring and less on the material properties of a single material or a single alloy. Multi-metallic canted-coil springs can allow for the application of highly conductive canted-coil springs in applications that demand extremely small size. For example, in medical electronic applications where a spring ring inside diameter is in the order of about 0.050 inch (or 50 thousandths) and a spring wire used to make such spring is about 0.003 to 0.0035 inch (or 3 thousandths to 3.5 thousandths) in diameter, the current challenge is find a suitable medically implantable metal that has sufficient strength and electrical conductivity for such application.

Typically, a noble metal is used, such as platinum or platinum alloy. However, such material has a lower working limit and therefore limits the industry.

Accordingly, aspects of the present invention include a medical connector comprising a groove for retaining a spring, said spring provided with an outside diameter of less than 0.0035 inch, a spring ring inside diameter of less than 0.050 inch, and wherein the spring has an inner core made from a first material having a first tensile strength and a first conductivity and an outer layer made from a second material having a second tensile strength and a second conductivity; wherein the first tensile strength is larger than the second tensile strength and wherein the second conductivity is larger than the first conductivity. In a specific embodiment, the multi-metallic wire comprising the first material may be made from a stainless steel material, a carbon steel material, incolloy, or hastelloy. In yet another specific embodiment, multi-metallic wire comprising the second material may be a noble metal or a noble metal alloy. Preferred noble metal and noble metal alloy include platinum and platinum iridium. In yet other embodiments, the spring ring inside diameter made from the multi-metallic metal is less than about 0.048 inch, such 0.040 inch. Preferred wire diameter for making such spring is less than 0.0028 inch, such as 0.002 inch.

What is claimed is:

1. A method for connecting and conducting electricity between a first body and a second body in an application above 200 degrees Celsius comprising:

inserting an elongated body of the second body comprising an external groove into a bore of the first body comprising an internal groove;

positioning a canted coil spring comprising a plurality of coils in a common groove defined by the first body and the second body so that the plurality of coils contact the external groove and the internal groove; and applying electrical current between the first body and the second body and through the spring;

exposing the first body and the second body to a temperature greater than 210 degrees Celsius; and wherein said spring comprising an inner core made from a highly electrically conductive material with a circumference and a secondary layer outside the core and completely surrounding the circumference of the core; said secondary layer comprising a high modulus and high tensile strength material.

2. The method of claim 1, wherein the core is made from a copper material.

3. The method of claim 1, wherein the plurality of coils contact two sidewalls of the internal groove.

4. The method of claim 1, wherein the secondary layer is at least one of coated and co-drawn with or to the inner bore.

5. The method of claim 1, wherein the spring has two ends that are spaced from one another.

6. The method of claim 1, wherein the first body and the second body are disposed in a wind turbine comprising at least one rotatable blade.

7. The method of claim 1, wherein at least one of the first body and the second body is plated with a conductive material.

8. The method of claim 1, wherein the first body or the second body is directly or indirectly connected to a battery terminal.

9. The method of claim 8, wherein the battery terminal is located in a water bearing vessel.

10. The method of claim 1, wherein the internal groove of the first body comprises two sidewalls and a bottom wall that tapers relative to the two sidewalls.

11. The method of claim 10, wherein the external groove of the second body comprises two sidewalls and a bottom wall located therebetween.

12. The method of claim 11, wherein the first body comprises an internal groove comprising two sidewalls and a bottom wall having a flat bottom surface.

13. The method of claim 1, further comprising an outer layer surrounding the secondary layer.

14. The method of claim 13, wherein the outer layer is made from a corrosion resistant material comprising titanium.

15. The method of claim 13, wherein the spring is a radial canted coil spring.

16. The method of claim 13, wherein the secondary layer comprises steel and the outer layer is a highly corrosion resistant metal.

17. The method of claim 16, wherein the outer layer comprises silver or titanium.

18. A method for transferring electrical current between a first member and a second member at a temperature of 210 degrees Celsius or higher, the method comprising:

providing a common groove defined by surfaces of the first member and the second member, disposing a multi-metallic canted coil spring comprising a plurality of coils in the common groove, said multi-metallic canted coil spring functions as a conduit for electrical conduction between the first member and the second member;

causing current to flow between the first member and the second member and through the canted coil spring;

exposing the first member, the second member, and the canted coil spring to a temperature of 210 degrees Celsius or higher; and wherein the canted coil spring includes an inner core made from a highly electrically conductive material comprising a circumference and a secondary layer outside the core and completely surrounding the circumference of the core; said secondary layer comprising a high modulus and high tensile strength material.

19. The method of claim 18, further comprising connecting a lead cable to at least one of the first member and the second member for carrying electrical current across a disconnectable interface.

20. The method of claim 18, wherein said canted coil spring has a wire outside diameter of less than 0.0035 inch, a spring ring inside diameter of less than 0.050 inch.

21. The method of claim 18, further comprising an outer layer surrounding the secondary layer.

22. The method of claim 18, wherein the core comprises copper.

23. The method of claim 22, wherein the secondary layer comprises steel.

24. The method of claim 23, further comprising a tertiary layer of a highly corrosion resistant metal outside and completely surrounding the secondary layer.

25. The method of claim 24, wherein the tertiary layer comprises silver or titanium.

* * * * *